United States Patent [19]

Kiuchi et al.

[11] Patent Number: 4,773,374

[45] Date of Patent: Sep. 27, 1988

[54] FUEL INJECTION SYSTEM FOR INTERNAL COMBUSTION ENGINE

[75] Inventors: Hideo Kiuchi, Aichi; Oyuki Ogawa, Okazaki; Hiroshi Yamazoe; Hitoshi Tasaka, both of Anjo; Minoru Kuroda, Nagoya; Susumu Okino, Kariay, all of Japan

[73] Assignee: Nippondenso Co., Ltd., Kariya, Japan

[21] Appl. No.: 912,850

[22] Filed: Sep. 29, 1986

[30] Foreign Application Priority Data

Oct. 3, 1985 [JP] Japan ..... 60-220726
Oct. 3, 1985 [JP] Japan ..... 60-220727

[51] Int. Cl.[4] ..... F02M 61/06

[52] U.S. Cl. ..... 123/470; 239/533.12; 239/552

[58] Field of Search ..... 239/533.3, 533.4, 533.5, 239/533.6, 533.7, 533.8, 533.9, 533.11, 533.12, 552, 585, 590, 601; 123/571, 470

[56] References Cited

U.S. PATENT DOCUMENTS

| | | | |
|---|---|---|---|
| 3,967,597 | 7/1976 | Schlagmuller et al. . | |
| 4,153,205 | 5/1979 | Parrish, Jr. | 239/533.12 X |
| 4,331,317 | 5/1982 | Kamai et al. . | |
| 4,331,318 | 5/1982 | Kamai et al. . | |
| 4,351,305 | 9/1982 | Isogai et al. . | |
| 4,524,914 | 6/1985 | Kaibara et al. | 239/533.12 X |
| 4,614,175 | 9/1986 | Asayama | 123/571 |
| 4,637,554 | 1/1987 | Takeda . | |
| 4,640,257 | 2/1987 | Kodama et al. . | |
| 4,657,189 | 4/1987 | Iwata et al. | 239/585 |

FOREIGN PATENT DOCUMENTS

| | | | |
|---|---|---|---|
| 330408 | 12/1920 | Fed. Rep. of Germany | 239/533.12 |
| 837337 | 4/1952 | Fed. Rep. of Germany | 239/533.3 |
| 170123 | 12/1977 | Japan . | |
| 88070 | 6/1985 | Japan . | |
| 968507 | 10/1982 | U.S.S.R. | 239/533.3 |
| 738769 | 10/1955 | United Kingdom | 239/533.4 |

OTHER PUBLICATIONS

Journal of Nippondenso Technical Disclosure No. 31-223, by Tomihiko Nagata Publ., Jul. 20, 1983-"Fuel Injector with Means for Changing Direction . . . ".

Journal of Nippondenso Technical Disclosure No. 33-064, by Kazuo Yamamoto Electro-Magnetic Fuel Injector, Publ. Jan. 15, 1984.

*Primary Examiner*—Tony M. Argenbright
*Assistant Examiner*—Eric R. Carlberg
*Attorney, Agent, or Firm*—Cushman, Darby & Cushman

[57] ABSTRACT

A fuel injector to be mounted on a branch of an engine intake manifold has a hollow body with an injection orifice therein and a valve member mounted slidably in the body and having a pintle extending from one end of the valve member and slidably received in and extending through the injection orifice. A sleeve member is mounted on the body to cover the injection orifice and defines a pintle-receiving space into which the forward end of the pintle extends. Communication apertures are formed in the outer end of the sleeve member to communicate the pintle receiving space with an engine intake passage. The total of the cross-sectional areas of the communication apertures is smaller than the cross-sectional area of the pintle-receiving space.

7 Claims, 7 Drawing Sheets

FUEL INJECTION SYSTEM FOR INTERNAL COMBUSTION ENGINE

FIELD OF THE INVENTION

The present invention relates to a fuel injection system for an internal combustion engine and, more particularly, to a fuel injection system having a fuel injector of a type that is electromagnetically actuated.

DESCRIPTION OF THE PRIOR ART

A conventional fuel injector, such as the one which is disclosed in Japanese Unexamined Utility Model Publication No. 60-88070 (88070/1985), has an electromagnetic coil and a needle valve which is actuated by the electromagnetic coil in response to an electric signal supplied to the coil. The needle valve opens and closes a fuel passage leading to an injection orifice thereby controlling the injection of fuel into the engine. The electric signal supplied to the electromagnetic coil is controlled by an engine controlling unit in such a manner that the fuel supply to the engine is optimized for the state of engine operation.

Most modern engines are each equipped with an exhaust gas recirculation system (referred to as "EGR system" hereinafter) in order to meet the current demand for prevention of environmental pollution. In general, an engine having an EGR system and a fuel injector of the type mentioned above mounted on an intake manifold encounters a problem that fine dust or particles suspended in the exhaust gases are recirculated through the EGR system and deposited on a portion of the fuel injector around the injection orifice and, particularly, on the outer surface of a pintel which projects outwardly through the injection orifice. As the deposit gradually becomes thicker to the extent that the deposited matter reaches the opening of the injection orifice, the effective area of this opening is decreased, so that the quantity of fuel injected into the engine is so reduced as to adversely affect the operation of the engine.

This problem is also encountered with engines which are not equipped with EGR systems. For instance, formation of heavy deposit around the injection orifice of an injector is often observed in engines which operate with low-grade fuels as well as in engines which suffer strong blow of the combustion gases back into the intake manifolds.

SUMMARY OF THE INVENTION

Accordingly, an object of the present invention is to provide a fuel injection system for an internal combustion engine capable of effectively suppressing the formation of deposit of dust and particles on the portion of the fuel injector around the injection orifice and, particularly, on the surface of the pintle, thereby ensuring smooth operation of the engine for a long time even when the injection system is used in an engine having an EGR system, an engine which operates with a low-grade fuel or an engine which suffers strong blow back of the combustion gases.

The fuel injection system according to the present invention is for use in an internal combustion engine provided with an intake passage, a cylinder associated with the intake passage and an intake valve associated with the cylinder. The injection system includes a fuel injector adapted to be disposed upstream of the intake valve. The fuel injector includes a housing, a hollow body connected to one end of the housing, a valve member disposed slidably in the body, and a pintle provided on the valve member for facilitating atomization of liquid fuel. The body has an end wall formed therein with an injection orifice. The pintle extends outwardly from the body through the injection orifice with a small gap left between an outer periphery of the pintle and an inner peripheral surface of the injection orifice to meter fuel to be injected. A sleeve member is mounted on the body to cover the injection orifice. The sleeve member defines therein a pintle-receiving space and at least one communication aperture adapted to communicate the pintle-receiving space with the intake passage of the engine. The cross-sectional area of the communication aperture is smaller than the cross-sectional area of the pintle-receiving space. The communication aperture is adapted to be directed to the intake valve when the injector is mounted on the engine.

With the above feature of the invention, because the cross-sectional area of the communication aperture is smaller than the cross-sectional area of the pintle-receiving space, any dust or particles which would be brought to the area near the fuel injector by the exhaust gases from an EGR system or by the combustion gases blowing back into the intake pipe cannot easily reach the region around the injection orifice and the pintle, since the flow of the gases suspending such dust and particles is restricted by the communication aperture. In consequence, deposite of dust and particles on the portion of the fuel injector around the injection orifice and the pintle is remarkably suppressed, so that the reduction in the fuel injection rate due to such deposit is restrained so as to enable the fuel injector to operate satisfactorily for a long time, even when the engine is equipped with an EGR system. For the same reason, the fuel injection system of the invention can operate for a long time even when the engine is operated with a low-grade fuel and suffers a strong blow back of the combustion gases.

DESCRIPTION OF THE PREFERRED EMBODIMENTS

Figure 4:
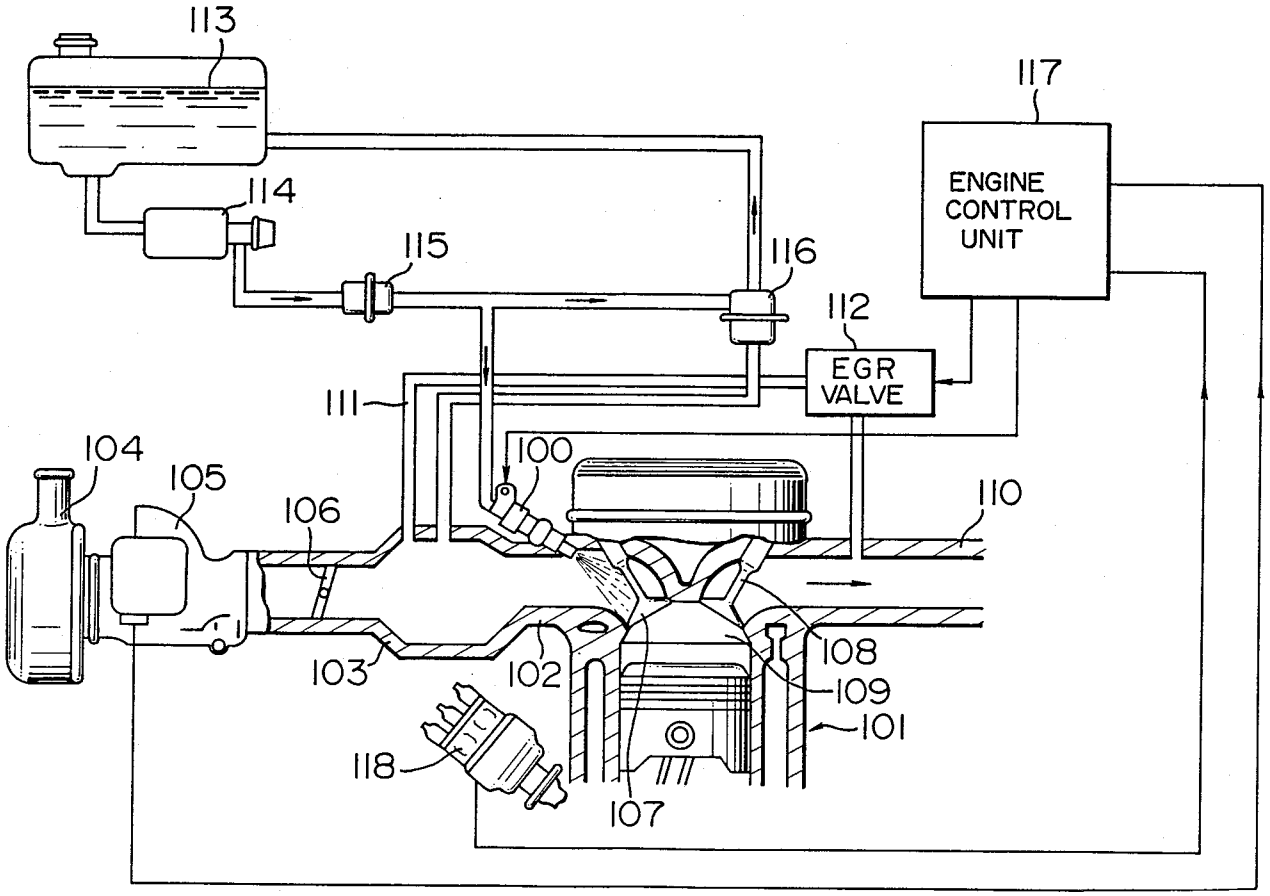
FIG. 4 is a schematic illustration of an internal combustion engine equipped with the fuel injection system of the invention and with other various component parts.

FIG. 4 schematically illustrates an internal combustion engine 101 equipped with an embodiment of the fuel injection system of the present invention.

The engine 101 has an intake manifold with branches 102 leading to respective cylinders of the engine. The fuel injection system includes a fuel injector which is generally denoted by reference numeral 100 and mounted such that its end slightly projects into each branch 102 of the intake manifold. The branches 102 gather in a surge tank 103 into which air is introduced through an air cleaner 104, air flow meter 105 and a throttle valve 106 in a manner known per se.

Each of the cylinders of the engine 101 is provided with an intake valve 107 and an exhaust valve 108. The fuel injector 100 is mounted on the branch 102 such that its end is positioned near the intake valve 107 so that the fuel injected by the fuel injector 100 and the air introduced into the branch 102 are mixed together to form an air-fuel mixture which is fed through the intake valve 107 into a combustion chamber 109 in the cylinder of the engine 101. The mixture introduced into the combustion chamber 109 is ignited by a spark plug (not shown) and explodes to generate combustion gases which are discharged into the atmosphere through the exhaust valve 108 and an exhaust pipe 110. An EGR passage 111 is connected to the exhaust pipe 110 and the surge tank 103 so as to permit a part of the exhaust gases to be recirculated to the surge tank 103. The EGR passage 111 is provided at an intermediate portion thereof with an EGR valve 112 which controls the flow of the exhaust gases recirculated through the EGR passage 111.

The fuel injector 100 is supplied with the fuel from a fuel tank 113 through a fuel filter 115 by the operation of a fuel pump 114, the delivery pressure of which is controlled by a pressure control valve 116 to be at a level which is higher by a predetermined value than the pressure in the surge tank 103.

An engine control unit 117 has a microcomputer which computes conditions optimum for the engine operation condition at any one moment, such as the opening duration of the fuel injector 100, operation of the EGR valve 112, and so forth, the computation being based on various signals such as a signal from the air flow meter 105 representing the intake air flow rate, a pulse signal derived from a distributor 118 and synchronous with the operation of the engine 101, and signals from other sensors not shown. The engine control unit 117 delivers signals corresponding to the results of the computation to the fuel injector 100 and the EGR valve 112 so as to control them.

Figure 1:
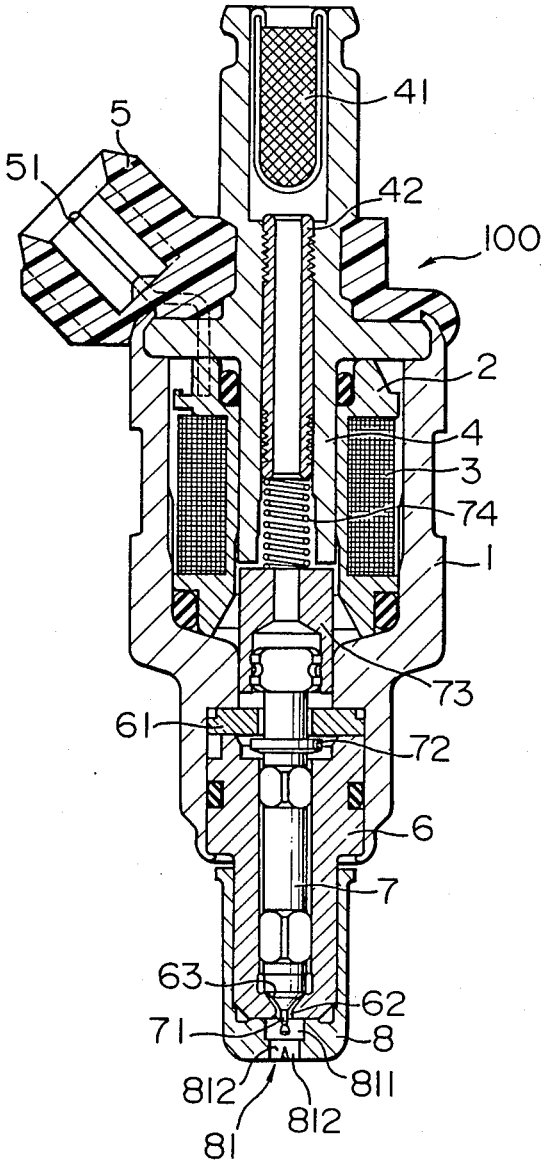
FIG. 1 is a longitudinal sectional view of an electromagentically actuated fuel injector (referred to simply as "fuel injector" hereinafter) of an embodiment of the fuel injection system in accordance with the present invention.
Figure 2:
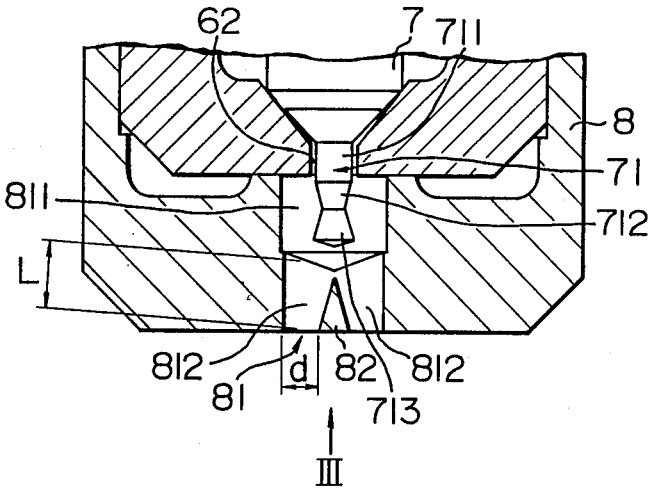
FIG. 2 is an enlarged fragmentary sectional view of a portion of the fuel injector shown in FIG. 1.
Figure 3:
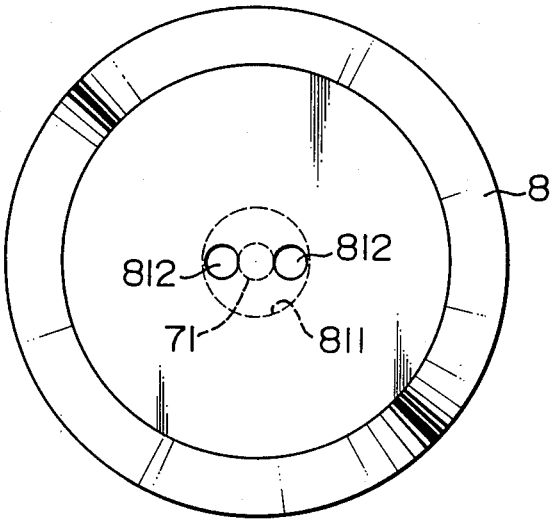
FIG. 3 is a bottom plan view of the fuel injector as viewed in the direction of an arrow III in FIG. 2.

FIGS. 1, 2 and 3 show the structural details of the fuel injector 100.

Referring first to FIG. 1, the fuel injector 100 has a housing 1 which is generally cylindrical and stepped to have portions of different diameters. More specifically, the housing 1 has a large-diameter portion which accommodates an electromagnetic coil 3 wound on a spool 2. The spool 2 has a central bore which tightly receives a tubular iron core 4, the upper end of which constitutes a connection to a fuel supply pipe. The tubular iron core 4 is provided at an intermediate portion thereof with a flange which rests on a shoulder formed on the inner peripheral surface of the housing 1. The upper end of the wall of the housing 1 is bent over the flange so that the iron core 4 is fixed to the housing 1. The opened upper end portion of the iron core 4 receives a fuel filter 41. An adjust pipe 42, which defines therein a fuel passage, is fixed to the inner surface of the iron core 4. A connector 5 for electrical power supply is formed integrally by molding a plastic material on the upper end portion of the housing 1. The connector 5 has a connector pin 51 which is electrically connected to the electromagnetic coil 3, so that voltage pulses corresponding to the outputs of the engine control unit 117 are fed to the electromagnetic coil 3 through the connector pin 51.

A hollow body 6 is fixed at one end to a small-diameter portion of the housing 1 with a spacer 61 interposed therebetween. The body 6 has an outer end which projects downwardly and outwardly from the lower end of the housing. The projecting end of the body 6 is closed by an end wall which is provided with an injection orifice 62 and a valve seat 63 adjacent to the injection orifice 62. The hollow of the body 6 slidably receives a needle valve 7 inserted from the upper side. The needle valve 7 is provided with a conical lower end portion which faces the valve seat 63. A pintle 71 is formed on the end extremity of the conical lower end portion of the needle valve 7. The needle valve 7 is further provided at its intermediate portion with a flange which constitutes a stopper 72 which cooperates with the spacer 61 to limit the upward stroke of the needle valve 7. A movable core 73 is fixed to the upper end of the needle valve 7 so as to axially oppose the iron core 4. A coiled spring 74 is disposed between the movable core 73 and the adjust pipe 42 so as to bias the movable core 73 downwardly.

A sleeve member 8 made of a metallic material is forcibly fitted around the outer or lower end of the body 6. An end opening 81 formed in the end wall of the sleeve 8 is aligned with the injection orifice 62 of the fuel injector 100 so that the fuel injected from the injection orifice 62 is introduced into the branch 102 of the intake manifold through the end opening 81. The sleeve 8 may alternatively be made of a plastic material.

FIGS. 2 and 3 illustrate the details of the constuction of the fuel injector 100 and, particularly, the end portion of the injector 100 exposed to the space in the branch 102 of the intake manifold. Referring to these Figures, the pintle 71 formed on the end extremity of the needle valve 7 has a cylindrical portion 711 of a constant diameter extending from the end extremity of the needle valve 7, a first tapered portion 712 connected to the end of the cylindrical portion 711 and having a diameter which progressively decreases from the diameter of the cylindrical portion 711, and a second tapered portion 713 connected to the first tapered portion 712 and having a diameter which progressively increases substantially to the same diameter as the cylindrical portion 711. The end extremity of the second tapered portion 713 is conical and converges downwardly. The cylindrical portion 711 of the pintle 71 extends through the injection orifice 62 such that a minute gap is formed between the outer peripheral surface of the cylindrical portion 711 and the inner peripheral surface of the injection orifice 62. The section of the pintle 71 including the first and the second tapered portions 712 and 713 projects beyond the injection orifice 62 and is positioned within a pintle-receiving space 811 which constitutes a part of the end opening 81. Thus, the fuel injected by the fuel injector 100 is metered by the annular space defined between the outer peripheral surface of the cylindrical portion 711 of the pintel 71 and the inner peripheral surface of the injection orifice 62.

The pintle-receiving space 811 formed in the sleeve member 8 has a volume which is large enough not to interfere the flow of fuel injected from the injection orifice 62 into the branch 102 of the intake manifold. Thus, the section of the pintle 71 received in the pintle-receiving space 811 and the surface of the wall defining this space 811 cooperate to define therebetween a substantially cylindrical space which extends along the length of the pintle 71. The clearance between the inner peripheral surface of the pintle-receiving space 811 and the section of the pintle 71 received in this space 811 is much greater than the clearance between the outer peripheral surface of the cylindrical portion 711 of the pintle 71 and the inner peripheral surface of the injection orifice 62. The axial length of the pintle-receiving space 811 is substantially the same as the length of the pintle 71 extending beyond the injection orifice 62. The end opening 81 of the sleeve member 8 includes at least two communication apertures 812 which provide communication between the pintle-receiving space 811 and the space in the branch 102. In the illustrated embodiment, there are two communication apertures 812. Each of the communication apertures is tapered to converge downward, i.e., towards the inside of the branch 102. Thus, the end opening 81 of the sleeve member 8 is constituted by the pintle-receiving space 811 and the communication apertures 812.

The communication apertures 812 are formed in symmetry with each other with respect to the axis of the pintle 71. The distance between the openings of these communication apertures in the end surface of the sleeve member 8 adjacent the branch 102 is substantially the same as the diameter of the pintle 71. The axes of the communication apertures 812 are inclined with respect to the axis of the pintle 71. As will be seen in the drawings, the total of the cross-sectional areas of the communication apertures 812 is selected to be much smaller than that of the pintle-receiving space 811. The total cross-sectional area of the communication apertures 812, however, is selected such that the fuel jet from the injection orifice 62 is smoothly introduced into the branch 102 without being restricted by the communication apertures. When the conical portion of the needle valve 7 is seated on the valve seat 63, a predetermined gap is left between the end extremity of the pintle 71 and the inner end of a partition 82 between the two apertures 812 so that the pintle 71 is never interfered by the partition 82.

When a voltage in the form of pulses is applied to the electromagnetic coil 3 of the fuel 100, the movable core 73 is pulled towards the iron core 4 against the force of the coiled spring 74, so that the needle valve 7 is lifted until the stopper 72 thereof abuts the spacer 61. Thus, the conical portion of the needle valve 7 is moved away from the valve seat 63, so that the pressurized fuel, which has been supplied through the adjust pipe 42 and the movable core 73 to the seal formed by the needle valve 7 and the valve seat 63, is relieved and injected through the injection orifice 62. The thus injected fuel is atomized by the second tapered portion 713 of the pintle 71 and the jet of the atomized fuel is guided by the pair of communication apertures 812 and introduced into the branch 102 of the intake manifold due to the difference between the injection pressure and the pressure in the intake manifold branch 102.

Figure 5:
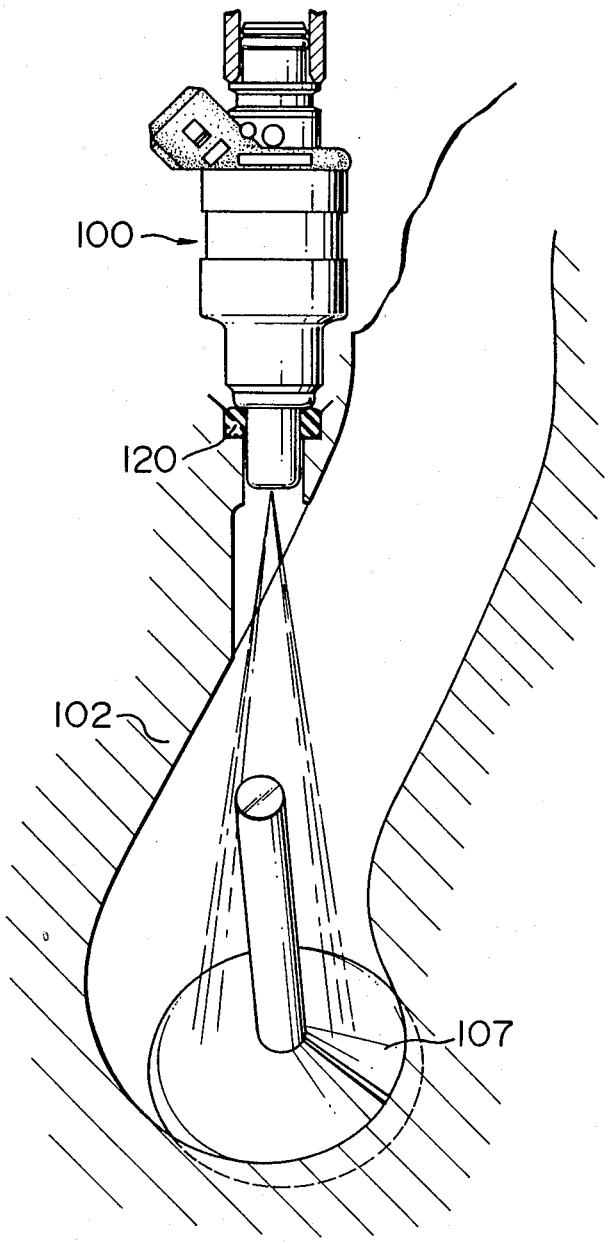
FIG. 5 is a schematic illustration of the fuel injector and an intake valve showing the direction of an injection of fuel.

FIG. 5 shows jets of fuel injected by the fuel injector 100 towards the intake valve 107. The fuel injector 100 is mounted on the branch 102 through the intermediary of an insulator 120 such that the end of the injector adjacent the branch 102 is directed towards the upper surface of the intake valve 107. Therefore, the jets of the fuel from the communication apertures 812 are directed towards the upper surface of the intake valve 107. When the engine has a pair of intake valves for each cylinder, the sleeve member 8 may be provided with a plurality of communication apertures and arranged such that two of the plurality of communication apertures are directed to one of the intake valves and the other apertures are directed towards the other intake valve.

It will be understood that, since the total of the cross-sectional areas of the communication apertures 812 is smaller than the cross-sectional areas of the pintle-receiving space 811, the intake air suspending dusts and other matters brought through the EGR system is restricted by the communication apertures 812 and, thus, can hardly reach the pintle-receiving space 811.

Figure 6:
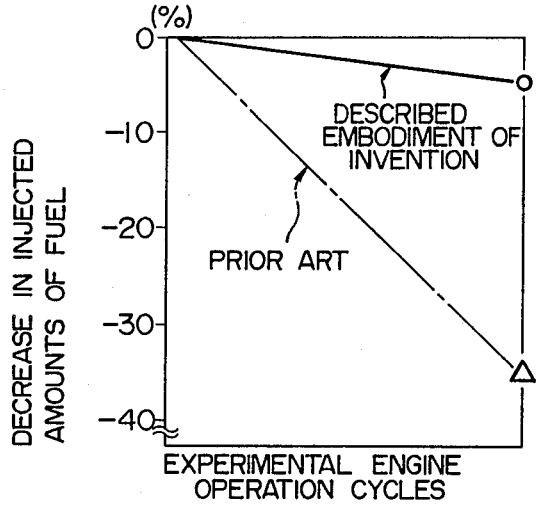
FIG. 6 is a graph showing the results of experimental tests conducted with the fuel injector shown in FIG. 1 and with a prior art fuel injector to examine the decrease in the injected amounts of fuel relative to experimental engine operation cycles.

In order to confirm the advantage of the invention, an experiment was conducted, in which the described fuel injector 100 shaped and sized to provide a desired fuel injection was mounted on an internal combustion engine of the type shown in FIG. 4 and the rate of decrease in the injected amounts of fuel in relation to the experimental engine operation cycles was observed. For a comparison purpose, a similar test was conducted with a conventional fuel injector of the type disclosed in Japanese Utility Model Unexamined Publication No. 88070/1985 mentioned before. The results of the experimental tests are shown in FIG. 6 from which it will be seen that the fuel injection system in accordance with the present invention suffers from only a small rate of decrease of the injected amounts of fuel, i.e., 5% or less, which is less than 1/7 of that observed with the conventional fuel injection system. From this fact, it is clearly understood that the fuel injection system of the present invention overcomes the aforesaid problems of the prior art. The term "engine operation cycle" means a cycle of engine operation in which the engine 101 was operated for a predetermined time period at a predetermined speed with the EGR valve opened and then the engine was stopped for a predetermined time period. The experimental tests were carried out by conducting a predetermined number of engine operation cycles, e.g., 100 cycles.

Figure 7:
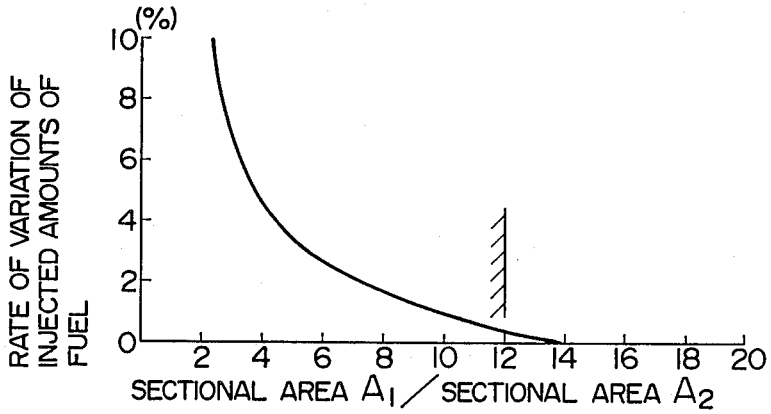
FIGS. 7–10 are graphs showing the results of experimental tests conducted to examine rates of variations of injected amounts of fuel relative to dimensional changes of the fuel injection orifice and a sleeve member of the injector according to the present invention.
Figure 8:
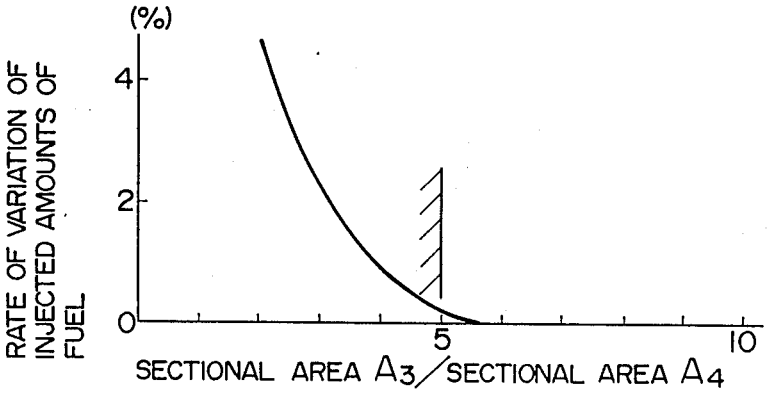

FIGS. 7 and 8 are graphs which show results of experiments which were conducted to investigate dimentional conditions of the injector 100 necessary for obtaining a desired amount of injected fuel. More specifically, the axis of the abscissa of FIG. 7 represents a ratio of the area $A_1$ of the pintle-receiving space 811 taken in a plane perpendicular to the axis of this space, i.e., the cross-sectional area of the pintle-receiving space 811, to the maximum cross-sectional area $A_2$ of the pintle 71 taken in a plane perpendicular to the axis of the pintle 71, while the axis of ordinate represents the rate of variation of the actual fuel injection amount with respect to the fuel injection amount which is desirable for a light-load operation of the engine. It will be seen that the actual fuel injection amount substantially equals to the desirable fuel injection amount when the value of the ratio $A_1/A_2$ is 12 or greater. However, when the value of the ratio $A_1/A_2$ is less than 12, the actual fuel injection amount undesirably exceeds the desirable fuel injection amount. This is considered to be attributable to the following reason: The fuel injected from the injection orifice 62 is introduced into the branch 102 of the intake manifold through the pintle-receiving space 811 and the communication apertures 812. Since the volume of the pintle-receiving space 811 is smaller, the pressure in this space 811 is lowered such that the difference between the fuel injection pressure and the pressure in the pintle-receiving space is greater than the difference between the fuel injection pressure and the pressure in the branch 102 of the intake manifold. In other words, vacuum is established in the pintle-receiving space 811 due to the high velocity of the jets of fuel in this space. In consequence, the fuel is forcibly sucked from the fuel injector, thus increasing the actual fuel injection amount.

The clearance between the pintle 71 and the inner peripheral surface of the injection orifice 62 is generally less than a few or several 100 μm, so that the cross-sectional area of the annular space between the pintle 71 and the inner peripheral surface of the injection orifice 62 is much smaller than the cross-sectional area A2 of the pintle. Therefore, the fuel injection amount is determined substantially solely by the outside diameter of the pintle 71 provided that other conditions such as the opening duration of the fuel injector and the fuel pressure are maintained constant. Thus, the cross-sectional area of the annular space between the outer peripheral surface of the pintle 71 and the inner peripheral surface of the injection orifice 62, which area determines the fuel injection amount, depends substantially directly on the cross-sectional area of the pintle 71. From the data shown in FIG. 7, it will be understood that, in order to obtain a high precision of fuel metering, it is necessary that the clearance between the outer peripheral surface of the pintle 71 and the inner peripheral surface of the pintle-receiving space 811 has to be sufficiently large as compared with the clearance between the outer peripheral surface of the pintle 71 and the inner peripheral surface of the injection orifice 62.

FIG. 8 shows the result of an experiment in which the total cross-sectional area $A_3$ of the pair of communication apertures 812 was varied while maintaining constant the cross-sectional area $A_4$ of the annular space between the outer peripheral surface of the pintle 71 and the inner peripheral surface of the injection orifice 62, in order to investigate how the fuel injection amount is varied in relation to the ratio $A_3/A_4$ of the cross-sectional areas. Thus, the axis of abscissa of FIG. 8 represents the ratio $A_3/A_4$ while the axis of ordinate represent the rate of variation of actual fuel injection amount with respect to the fuel injection amount desirable for a light-load operation of the engine. From this Figure, it will be seen that the actual fuel injection amount substantially equals to the desirable fuel injection amount when the ratio $A_3/A_4$ is greater than 5. The fact that the actual fuel injection amount exceeds the desirable fuel injection amount in the region of the ratio $A_3/A_4$ below 5 is attributable to the same reason as that explained before in connection with FIG. 7, i.e., to the above-described phenomenon occurring in the pintle-receiving space 811 due to too small volume thereof. The data shown in FIG. 8 suggests that, in order to obtain a high precision of metering of the fuel, it is necessary that the total cross-sectional area $A_3$ of the pair of communication apertures 812 has to be sufficiently large as compared with the cross-sectional area $A_4$ of the annular space between the outer peripheral surface of the pintle 71 and the inner peripheral surface of the injection orifice 62.

As will be understood from the foregoing description with reference to FIGS. 7 and 8, it will be realized that almost no difference is caused between the desirable fuel injection amount and the actual fuel injection amount even when the total cross-sectional area of the pair of communication apertures 812 is smaller than that of the pintle-receiving space 811, provided that the value of the ratio $A_1/A_2$ is not smaller than 12 and that the value of the ratio $A_3/A_4$ is not smaller than 5.

The fuel tends to be vaporized in the fuel injector when the fuel temperature is increased or when a vacuum is established in the branch 102 of the intake manifold due to deceleration of the engine. The vaporization of the fuel adversely affects the precision of metering of fuel particularly when a structure which restricts the jets of the injected fuel is disposed downstream of an injection orifice as in the described fuel injector.

Figure 10:
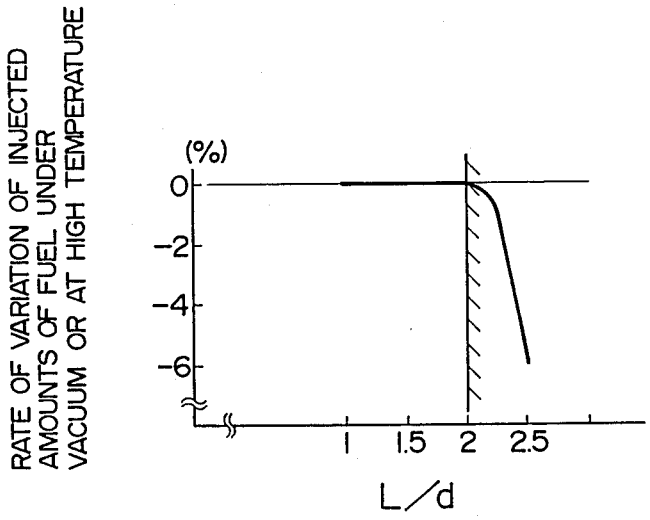

This problem, however, can be overcome by designing the fuel injector to meet the following conditions:

$$A_3/A_4 \geqq 5.5 \quad (1)$$

where $A_3$ represents the total cross-sectional area of the pair of communication apertures 812, while $A_4$ represents the cross-sectional area of the annular space between the outer peripheral surface of the pintle 71 and the inner peripheral surface of the injection orifice 62 (see FIG. 9); and $$L/d \leqq 2 \quad (2)$$

where L represents the length of each communication aperture 812 and d represents the minimum diameter of each communication aperture 812 (see FIG. 10).

It is of course essential that the value of the ratio $A_1/A_2$ between the cross-sectional area of the pintle-receiving space 811 and the cross-sectional area $A_2$ of the pintle 71 meets the aforementioned condition of $A_1/A_2 \geqq 12$.

Figure 9:
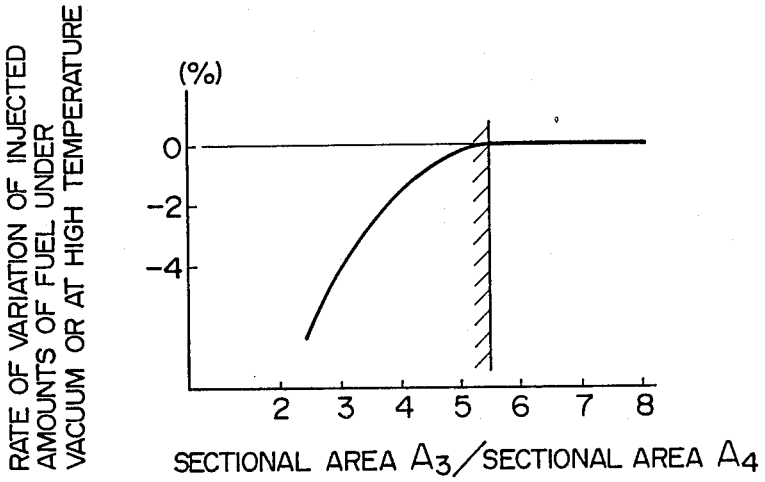

FIGS. 9 and 10 are graphs which show operation characteristics of a fuel injector constructed in accordance with the above-mentioned conditions.

It will be understood that the restriction imposed by the communication apertures 812, which is intended to prevent any dusts and other matters brought by, for example, an EGR system from reaching the region around the pintle 71 and the injection orifice 62, does not materially impair the fuel metering precision, provided that the above-mentioned conditions are met.

Although the fuel injector used in the described embodiment has a pair of communication apertures, the invention does not exclude the use of three or more communication apertures or only one communication aperture which is coaxial with the pintle, and such modifications fall within the scope of the present invention.

A second embodiment of the invention will be described hereinunder with reference to FIGS. 11 and 12.

Figure 11:
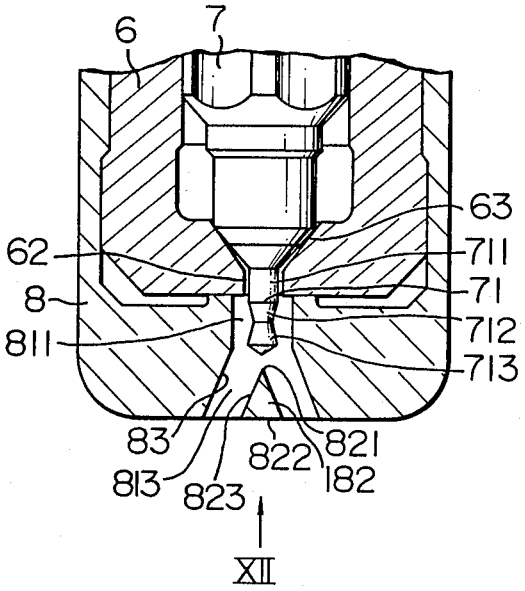
FIG. 11 is similar to FIG. 2 but shows a fuel injector incorporated in a second embodiment of the fuel injection system in accordance with the present invention.
Figure 12:
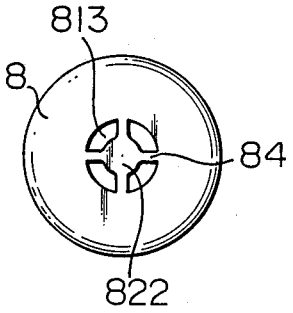
FIG. 12 is a bottom view taken in the direction of an arrow XII in FIG. 11.

FIG. 11 is an enlarged longitudinal sectional view of a part of a fuel injector used in the second embodiment of the invention, showing particularly the construction of the fuel injector around the injection orifice, while FIG. 12 is a bottom view as taken in the direction of the arrow XII in FIG. 11. In these Figures, the same reference numerals as in the preceding drawings are used to denote the same parts or members as those of the first embodiment and detailed description of such parts or members is omitted.

In the fuel injector shown in FIG. 11, the sleeve member 8 has an integral conical guard portion 182 coaxial with the pintle 71 and facing the end of the pintle 71. A minute gap is left between the end extremity of the pintle 71 and the inner end 821 of the guard portion 182 so that the pintle 71 is not interfered by the guarde portion 182 even when it is in its lower stroke end. The surface 822 of the guard portion 182 facing the branch 102 of the intake manifold has a diameter which is substantially the same as or somewhat greater than the outside diameter of the cylindrical portion 711 or the maximum outside diameter of the second tapered portion 713 of the pintle 71. A plurality of communication apertures 813 each having an arcuate or sector shape are formed in the portion of the end wall of the sleeve member 8 around the guard portion 182 so as to provide a communication between the pintle-receiving space 811 and the interior of the branch 102 of the intake manifold. In the illustrated embodiment, the sleeve member 8 has four communication apertures 813 so that the guard portion 182 is supported by four bridges 84 integral with the sleeve member 8. These communication apertures 813 as well as the pintle-receiving space 811 have cross-sectional areas large enough not to interfere the jets of fuel injected from the injection orifice 62 into the branch 102 of the intake manifold. The tapered wall surface 83 of each communication aperture 813 is parallel to the conical surface 823 of the guard portion 182 and the distance between these parallel surfaces is so selected as not to adversely affect the flow of the fuel injected from the injection orifice 62 and atomized upon collision against the second tapered portion 713 of the pintle 71. At the same time, the length of the portion of the sleeve member 8 where the communication apertures 813 are formed, as measured in the direction of the axis of the pintle 71, is selected to be substantially the same as the axial length of the pintle-receiving space 811. If the length of the communication apertures 813 is large, the atomized fuel has to travel a long distance before reaching the branch 102 of the intake manifold with a result that a considerably large part of the atomized fuel would undesirably be attached to the conical surface 823 and the tapered surface 83. The sleeve member 8 having the described construction can easily be formed by molding a plastic material.

The cross-sectional area of the pintle-receiving space 811 should preferably be smaller than the total of the areas of the openings of the communication apertures 813 to the intake passage of the intake manifold branch 102, as in the first embodiment of the invention, and can be decreased by, for example, increasing the width or circumferential dimension of each of the bridges 84. Each bridge 84 may preferably have a wedge-shaped section with a sharp edge thereof directed towards the pintle-receiving space 811 so as to minimize the interference of the bridges with the jets of the fuel passing through the communication apertures 813.

In this embodiment of the present invention, fine dusts and other matters brought into the surge tank 103 by the exhaust gases recirculated through the EGR passage 111 (see FIG. 4) past the EGR valve 112 can hardly reach the portion of the fuel injector around the pintle 71 and the injection orifice 62 due to the presence of the guard portion 182.

An experiment similar to that explained before in connection with FIG. 6 was conducted with the fuel injector shown in FIGS. 11 and 12 and a conventional fuel injector disclosed in Japanese Un-examined Utility Model Publication No. 88070/1985. In the experiment, these fuel injectors were mounted on an internal combustion engine as shown in FIG. 4 and the rates of decrease in the fuel injection amount was examined in relation to the experimental engine operation cycles. The result was substantially the same as that shown in FIG. 6. Namely, the fuel injector of the fuel injection system of the invention showed a rate of decrease of the fuel injection amount which is about 5%, while the conventional fuel injector showed a rate of decrease in the fuel injection amount which is as large as 35%.

What is claimed is:

1. A fuel injection system for an internal combustion engine provided with an intake passage, a cylinder associated with said intake passage and at least one intake valve associated with said cylinder, said fuel injection system including a fuel injector adapted to be disposed upstream of said intake valve, said fuel injector comprising:

a housing;

a hollow body connected to one end of said housing said hollow body having an end wall formed therein with an injection orifice;

a valve member disposed slidably in said body comprising a needle valve of the type that is electromechanically operated;

a pintle provided on said valve member for facilitating atomization of liquid fuel, said pintle extending outwardly from said hollow body through said injection orifice with a gap between an outer periphery of said pintle and an inner peripheral surface of said injection orifice to meter fuel to be injected;

a sleeve member mounted on said hollow body to cover said injection orifice, said sleeve member defining therein a pintle-receiving space and a plurality of communication apertures adapted to communicate said pintle-receiving space with said intake passage of said engine, the total of the cross-sectional areas of said communication apertures being smaller than the cross-sectional area of said pintle-receiving space, and wherein the ratio of the total of the cross-sectional areas of said communication apertures relative to the cross-sectional area of said gap between said pintle and said injection orifice is not less than 5.5 and wherein each of said communication apertures has a length axially of said pintle and a minimum diameter, the ratio of said length relative to said minimum diameter being less than 2 and at least two of said communication apertures being adapted to be directed to one intake valve when said injector is mounted on said engine.

2. A fuel injection system according to claim 1, wherein said engine is of the type that is provided with an E.G.R. system.

3. A fuel injection system according to claim 1, wherein said pintle has an outer peripheral surface cooperating with an inner peripheral surface of said pintle-receiving space to define a clearance substantially greater than the gap defined between said pintle and said injection orifice.

4. A fuel injection system for an internal combustion engine provided with an intake passage, a cylinder associated with said intake passage and at least one intake valve associated with said cylinder, said fuel injection system including a fuel injector adapted to be disposed upstream of said intake valve, said fuel injector comprising:

a housing;

a hollow body connected to one end of said housing said hollow body having an end wall formed therein with an injection orifice;

a valve member disposed slidably in said body comprising a needle valve of the type that is electromechanically operated;

a pintle provided on said valve member for facilitating atomization of liquid fuel, said pintle extending outwardly from said hollow body through said injection orifice with a gap between an outer periphery of said pintle and an inner peripheral surface of said injection orifice to meter fuel to be injected;

a sleeve member mounted on said hollow body to cover said injection orifice, said sleeve member defining therein a pintle-receiving space and a plurality of communication apertures adapted to communicate said pintle-receiving space with said intake passage of said engine, the total of the cross-sectional areas of said communication apertures being smaller than the cross-sectional area of said pintle-receiving space, and wherein the ratio of the cross-sectional area of said pintle-receiving space relative to the cross-sectional area of said pintle is not less than 12 and wherein the ratio of the total of the cross-sectional areas of said communication apertures relative to the cross-sectional area of said gap between said pintle and said injection orifice is not less than 5.5 and at least two of said communication apertures being adapted to be directed to one intake valve when said injector is mounted on said engine.

5. A fuel injection system for an internal combustion engine provided with an intake passage, a cylinder associated with said intake passage and an intake valve associated with said cylinder, said fuel injection system including a fuel injector adapted to be disposed upstream of said intake valve, said fuel injector comprising:

a housing;

a hollow body connected to one end of said housing having an end wall formed therein with an injection orifice;

an electromagnetically actuated valve member disposed slidably in said body hollow;

a pintle provided on said valve member for facilitating atomization of liquid fuel, said pintle extending outwardly from said hollow body through said injection orifice with a small gap left between an outer periphery of said pintle and an inner peripheral surface of said injection orifice to meter fuel to be injected;

a sleeve member mounted on said hollow body to cover said injection orifice, said sleeve member defining therein a pintle-receiving space and at least one communication aperture adapted to communicate said pintle-receiving space with said intake passage of said engine, the cross-sectional area of said communication aperture being smaller than the cross-sectional area of said pintle-receiving space and the ratio of the cross-sectional area of said pintle-receiving space relative to the cross-sectional area of said pintle being not less than 12, said communication aperture being adapted to be directed to said intake valve when said injector is mounted on said engine.

6. A fuel injection system according to claim 5, wherein said pintle has an outer peripheral surface cooperating with an inner peripheral surface of said pintle-receiving space to define a clearance substantially greater than the gap defined between said pintle and said injection orifice.

7. A fuel injection system according to claim 5, wherein said sleeve member has an outer end section in which said communication aperture is formed, said end section having a length measured axially of said pintle, said length being substantially equal to the axial length of said pintle-receiving space.

* * * * *